United States Patent [19]

Sartor

[11] Patent Number: 4,599,813

[45] Date of Patent: Jul. 15, 1986

[54] RAKE ADJUSTING DEVICE FOR THE LEG PORTION OF A SKI BOOT

[76] Inventor: Mariano Sartor, Via Barile 10, Montebelluna, Italy

[21] Appl. No.: 580,486

[22] Filed: Feb. 15, 1984

[30] Foreign Application Priority Data

Feb. 22, 1983 [IT] Italy ..... 20891/83[U]

[51] Int. Cl.[4] ..... A43B 5/04

[52] U.S. Cl. ..... 36/117; 36/54; 36/120

[58] Field of Search ..... 36/117–121, 36/54

[56] References Cited

U.S. PATENT DOCUMENTS 3,868,783 3/1975 Caporicci ..... 36/120

FOREIGN PATENT DOCUMENTS 1810291 6/1970 Fed. Rep. of Germany ..... 36/54

*Primary Examiner*—James Kee Chi

[57] ABSTRACT

A rake adjusting device for the leg portion of a ski boot comprises a position-adjustable detent element which is carried on the leg portion hingedly connected to the shell of a ski boot. The detent element is movable into a first position, whereat it engages by contact with a first projecting element rigid with the shell, and a second position whereat it disengages from the first projecting element and a travel stop contact is established between the leg portion and shell through a stop element attached to the leg portion and a second projecting element attached to the shell.

6 Claims, 5 Drawing Figures

RAKE ADJUSTING DEVICE FOR THE LEG PORTION OF A SKI BOOT

BACKGROUND OF THE INVENTION

This invention relates to a rake adjusting device for the leg portion of a ski boot.

As is known, ski boots generally comprise a shell whereto a leg portion is connected hinge-fashion which is imparted a forward rake. In order to be able to adjust the extent of the leg portion rake relatively to the shell, there have been provided for ski boots a variety of devices acting between the shell and leg portion of the boot to position the leg portion with a given rake to the shell with the ski boot in the condition of non-use.

Such prior devices, additionally to being mostly complicated, have proved difficult to install on rear entry boots, wherein the leg portion is split into a front leg portion and rear leg portion.

SUMMARY OF THE INVENTION

It is an object of this invention to obviate such prior drawbacks by providing a rake adjusting device for the leg portion of a ski boot which is specially useful with ski boots having a split leg portion.

A further object of the invention is to provide a device as indicated which is constructionally simple and can be operated quite rapidly.

It is another object of this invention to provide a rake adjusting device as indicated, which allows for a slight forward swinging movement to better meet the requirements of situations arising in skiing practice.

A not unimportant object of the invention is to provide a rake adjusting device as indicated, which can give full assurance of being reliable and safe to operate.

These and other objects, such as will be apparent hereinafter, are achieved by a rake adjusting device for a tiltable leg portion of a ski boot having a shell portion on which at least one leg portion is tiltably connected, characterized in that said leg portion has at least a first stop formation defining a path along which said first stop is moved when said leg portion is moved from a first position thereof to a second position thereof and said shell portion has at least a second stop formation arranged in the path of said first stop formation and wherein said device further comprises a releasable detent mechanism releasably engageable with one of said stop formations in one position of said leg portion to maintain said leg portion in said one position thereof and disingageable from said one stop formation to allow said leg portion to attain another relative position thereof with respect to said shell portion.

BRIEF DESCRIPTION OF THE DRAWINGS

Further features and advantages will be more readily apparent from the following detailed description of this rake adjusting device for the leg portion of a ski boot, in conjunction with the accompanying illustrative drawing, where.

DESCRIPTION OF THE PREFERRED EMBODIMENTS

Figure 3:
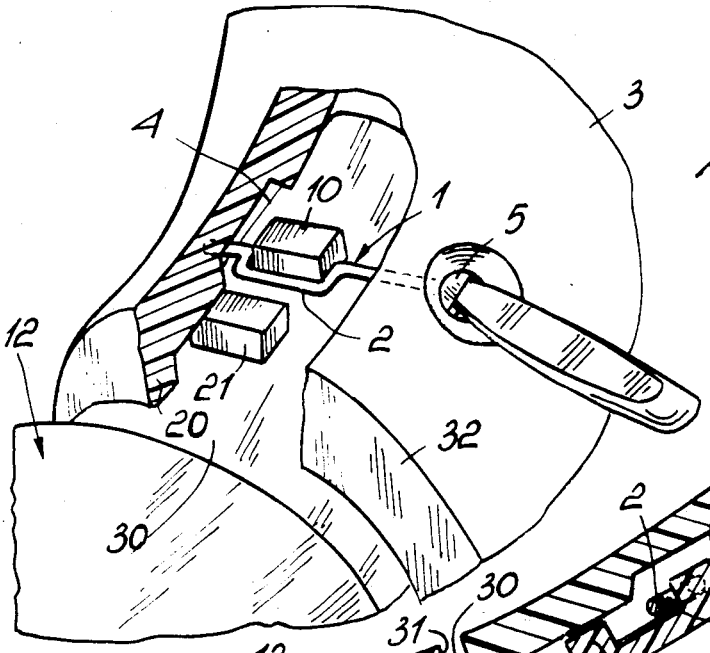
FIG. 3 is a partly cutaway perspective view showing this device with the stop element in its first position.

Making reference to the drawing views, a rake adjusting device for the leg portion of ski boots, according to the invention, comprises a detent element which includes a shaft 1 having a gooseneck 2 formed at a middle portion thereof, which shaft is carried rotatably at its ends on the front upper portion of the leg portion 3. More specifically, the gooseneck portion of said shaft 1 is received in a recess 4 defined in the bottom side of the front upper portion of said leg portion or quarter 3, thereby to allow free rotation of the gooseneck shaft portion, while the ends of the shaft 1 are journalled within holes provided in the walls of the leg portion.

The shaft 1 forming said detent element is set with one end thereof emerging at the outer surface of the quarter 3, and has there a head 5 provided with a diametrically extending screwdriver slot 6 for actuating the shaft.

Figure 2:
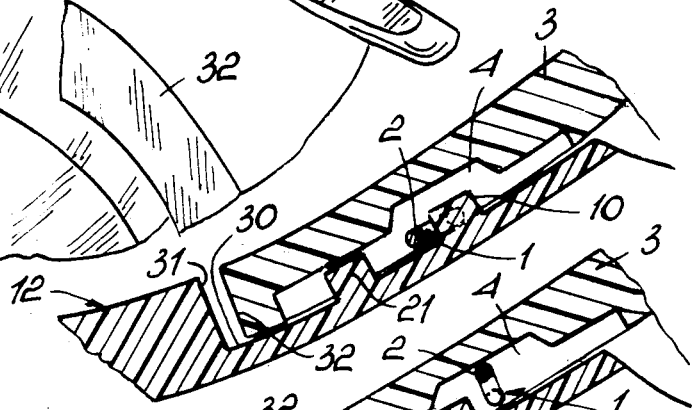
FIG. 2 is a longitudinal section view through this device, with the stop element in its first position.

Said shaft 1 may be moved into a first position (FIGS. 2 and 3), whereat the gooseneck section 2 will engage by contact with the front of a first projecting element comprising a parallelepipedal block 10 secured to the upper portion of the shell 12 whereto the quarter 3 is hingedly connected.

Figure 4:
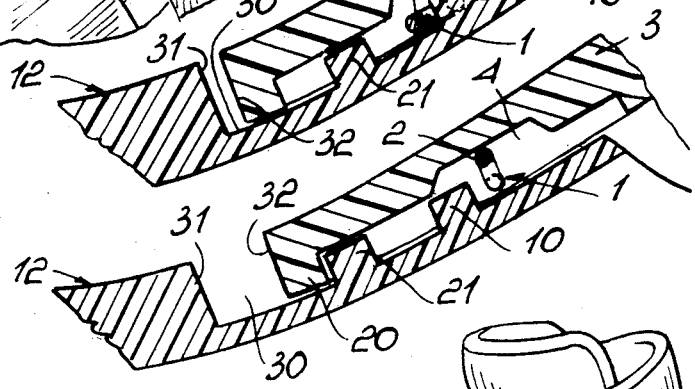
FIG. 4 is a sectional view of this device, with the stop element in its second position.
Figure 5:
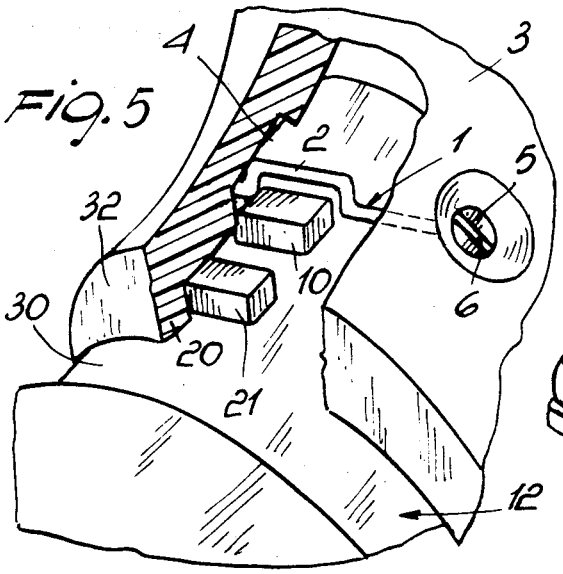
FIG. 5 is a partly cutaway view of this device, with the stop element in its second position.
Figure 1:
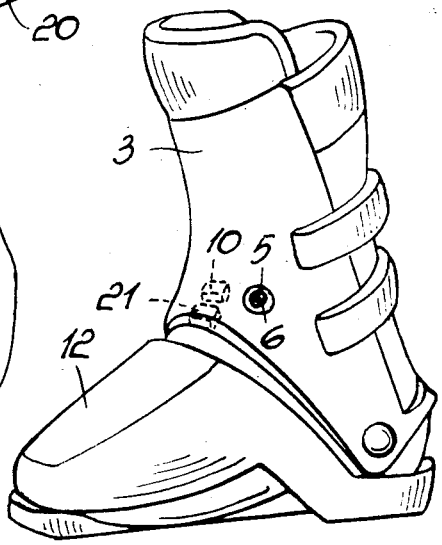
FIG. 1 shows schematically a ski boot incorporating the rake adjusting device of this invention.

The shaft 1, as mentioned, is rotatable about its own axis by acting on its widened head 5 to bring it in a second position (FIGS. 4 and 5) where its gooseneck middle section 2 does not interfere with the first parallelepipedal block 10.

At said second position, the relative movement between the leg portion 3 and shell 12 is limited by a shoulder 20 which is attached to the front edge of the quarter 3 and adapted to engage by contact with a second projecting element formed by a second block 21 affixed to the shell 12 and being located away from the first block 10.

It should be added to the foregoing that the shell 12, at the area thereof being overlapped by the leg portion 3, has a recess 30 bordered by an abutment edge 31 against which the front edge 32 of the leg portion 3 may be engaged to act as a stop element for the quarter forward swing.

The rake adjusting device of this invention is quite simple to operate; in fact, where one wishes to keep the leg portion 3 relatively raked with respect to the shell 12, it will be sufficient to place the shaft 1 into its first position, such that the engagement between the gooseneck section 2 and block 10 can hold the leg portion at a relative rake.

When the user wishes to reduce the rake angle, all he/she has to do is to turn the shaft 1 through 90° about its axis, thereby disengaging the shaft 1 from the first block 10 and having the travel limit between the leg portion 3 and shell 12 established by the shoulder 20 against a second projecting element comprising the second block 21.

It may be appreciated from the above description that the invention achieves its objects, and in particular that an adjusting device has been provided which is contained within the inner surface of the front region of the leg portion and outer surface of the ski boot shell, thus being concealed from view and adequately protected against seepage and the like.

Further, this device is quite simple to operate, it being actuated by simply turning the widened head with a screwdriver or the like to directly switch from one position over into the other.

In practicing the invention, the materials used, as well as the dimensions and contingent shapes, may be any selected ones to meet individual requirements.

Thus for example in the embodiment shown a first block 10 and a second block 21 are present. Even though the use of two such blocks may have advantages of different kind and in particular for the selection of a suitable rake interval, the invention is not limited to the number of such blocks or stop formations and it will be apparent that the device is operable also with a single block 10 or 21 by adapting the relative distance between the block and the shoulder 20.

I claim:

1. A rake adjusting device for the leg portion of a ski boot, comprising a detent element carried on a leg portion hingedly connected to a ski boot shell, said detent element being movable into a first position, whereat it engages by contact with a first projecting element attached to said shell, and a second position, whereat it disengages from said first projecting element and the travel limit contact between said leg portion and said shell is established via a stop element, attached to said leg portion, and a second projecting element, attached to said shell, wherein said detent element, engaging the first projecting element, comprises a shaft carried rotatably on said leg portion and extending across said leg portion.

2. A device according to claim 1, characterized in that said shaft is formed at a middle portion thereof with a gooseneck section located partially around said first projecting element, said shaft being accommodated within a recess defined in the inner side of said leg portion.

3. A device according to claim 1, characterized in that said first projecting element comprises a parallelepipedal block provided in said shell at an area thereof being overlapped by said leg portion.

4. A device according to claim 1, characterized in that said stop element is defined at the front edge of said leg portion and said second projecting element includes a second block attached to said shell away from said first projecting element.

5. A device according to claim 1, characterized in that said shell defines a recess at an area thereof overlapped by said leg portion, said recess defining an abutment edge adapted to interfere with the front edge of said leg portion to act as a stop element for the forward swing of said leg portion relatively to said shell.

6. A device according to claim 1, characterized in that said shaft has one end emerging at the outside of said leg portion, said end being provided with a widened head having a slot therein for turning said shaft.

* * * * *